US008574052B1

(12) United States Patent
Nottke

(10) Patent No.: US 8,574,052 B1
(45) Date of Patent: Nov. 5, 2013

(54) BONUS DISCARD POKER

(75) Inventor: Timothy G. Nottke, Toledo, OH (US)

(73) Assignee: Imaging Systems Technology, Inc., Toledo, OH (US)

( * ) Notice: Subject to any disclaimer, the term of this patent is extended or adjusted under 35 U.S.C. 154(b) by 0 days.

(21) Appl. No.: 13/400,081

(22) Filed: Feb. 19, 2012

Related U.S. Application Data

(63) Continuation-in-part of application No. 12/336,825, filed on Dec. 17, 2008, now abandoned.

(60) Provisional application No. 61/020,160, filed on Jan. 10, 2008.

(51) Int. Cl.
*G07F 17/32* (2006.01)

(52) U.S. Cl.
USPC ..... 463/13; 273/272

(58) Field of Classification Search
USPC ..... 273/292; 463/13
See application file for complete search history.

(56) References Cited

U.S. PATENT DOCUMENTS

| | | | |
|---|---|---|---|
| 5,294,120 | A | 3/1994 | Schultz |
| 5,322,295 | A | 6/1994 | Cabot et al. |
| 5,415,404 | A | 5/1995 | Joshi et al. |
| 5,531,441 | A | 7/1996 | Dabrowski et al. |
| 5,597,162 | A | 1/1997 | Franklin |
| 5,823,873 | A | 10/1998 | Moody |
| 5,868,619 | A | 2/1999 | Wood et al. |
| 5,882,258 | A | 3/1999 | Kelly et al. |
| 5,976,016 | A | 11/1999 | Moody et al. |
| 6,007,066 | A | 12/1999 | Moody |
| 6,098,985 | A | 8/2000 | Moody |
| 6,132,311 | A | 10/2000 | Williams |
| 6,146,271 | A | 11/2000 | Kadlic |
| 6,149,521 | A | 11/2000 | Sanduski |
| 6,220,959 | B1 | 4/2001 | Holmes, Jr. et al. |
| 6,257,979 | B1 * | 7/2001 | Walker et al. ..... 463/13 |
| 6,474,645 | B2 | 11/2002 | Tarantino |
| 6,533,279 | B2 | 3/2003 | Moody et al. |
| 6,585,587 | B2 | 7/2003 | Falciglia, Sr. |
| 6,652,377 | B1 | 11/2003 | Moody |
| 7,247,092 | B2 | 7/2007 | Jarvis et al. |
| 7,448,947 | B2 | 11/2008 | Englman et al. |
| 7,614,946 | B2 | 11/2009 | Nicely |
| 7,785,182 | B2 | 8/2010 | Thomas et al. |
| 7,857,693 | B1 | 12/2010 | Johnson et al. |
| 8,016,656 | B2 | 9/2011 | Berman et al. |
| 8,105,144 | B2 | 1/2012 | Englman et al. |
| 8,147,310 | B2 | 4/2012 | Jarvis et al. |
| 8,152,616 | B2 | 4/2012 | Moody |
| 8,210,533 | B2 | 7/2012 | Evans et al. |
| 2003/0038425 | A1 | 2/2003 | Tarantino |
| 2003/0153377 | A1 | 8/2003 | Lisowski |
| 2004/0132524 | A1 | 7/2004 | Ramstad et al. |

(Continued)

*Primary Examiner* — Omkar Deodhar
(74) *Attorney, Agent, or Firm* — Donald K. Wedding

(57) ABSTRACT

A method and system for playing video poker wherein a primary five card hand is dealt and secondary hands is played from the discarded cards of the primary hand. The remaining cards for each hand are dealt from the remainder of a deck of cards which can be a standard deck of 52 cards. The game may be played on site at a legal game casino, in a non-gambling mode on-line over the internet, or off-line on a home computer using a disc such as a compact disc. The game could also be played as a legal game in gambling or non-gambling mode at a tavern, bar, or the like.

3 Claims, 16 Drawing Sheets

(56) References Cited

U.S. PATENT DOCUMENTS

2005/0173863 A1* 8/2005 Walker et al. ..... 273/292
2005/0230917 A1 10/2005 Jackson
2007/0241504 A1 10/2007 Mou et al.
2010/0227663 A1 9/2010 Muskin
2011/0201398 A1 8/2011 Parham

* cited by examiner

BONUS DISCARD POKER

RELATED APPLICATION

This application is a continuation-in-part under 35 U.S.C. 120 of copending U.S. patent application Ser. No. 12/336,825, filed Dec. 17, 2008 now abandoned which claims priority under 35 U.S.C. 119(e) for U.S. Provisional Application Ser. No. 61/020,160 filed Jan. 10, 2008, all incorporated herein by reference.

FIELD OF INVENTION

This invention relates to a method for playing video poker wherein a primary five card hand is dealt and a secondary hand may be played from the discarded cards of the primary hand. The remaining cards for each hand are dealt from the remainder of a standard deck of 52 cards.

RELATED PRIOR ART

The following references disclose a video poker game wherein multiple hands are dealt per game for a single player: U.S. Pat. Nos. 6,098,985 (Moody), 6,474,645 (Tarantino), 6,511,068 (Sklansky et al.), 6,561,898 (Moody), 7,247,092 (Jarvis et al.), 7,156,397 (Moody et al.), 6,443,456 (Gajor), U.S. Patent Application Nos. 2003/0038425 (Tarantino), 2004/0219970 (Tarantino), and 2005/0026668 (Tarantino), all incorporated herein by reference.

U.S. Patent Application No. 2006/0287058 (Resnick et al.) discloses a gaming system with multiple game types, and is incorporated herein by reference.

U.S. Patent Application No. 2007/0155500 discloses a multiple player video poker game, and is incorporated herein by reference.

The following references disclose an improved poker game: U.S. Pat. Nos. 7,137,628 (Moody), 7,222,856 (Dodge), 7,222,857 (Moody), 7,222,858 (Moody), U.S. Patent Application 2006/0281513 (Kirkpatrick), all incorporated herein by reference.

The following references disclose a gaming device with a bonus scheme: U.S. Pat. Nos. 6,506,118 (Baerlocher et al.), 6,514,141 (Kaminkow et al.), 7,022,016 (Wood et al.), and 7,247,092 (Jarvis et al.), all incorporated herein by reference.

The following prior art references disclose electronic or computerized gaming devices: U.S. Pat. Nos. 5,042,809 (Richardson), 6,248,016 (Walker et al.), 6,332,839 (Walker et al.), 7,022,016 (Wood et al.), 7,222,857 (Moody), 7,247,091 (Moody), U.S. Design Pat. No. Des. 395,463 (Scott et al.), and U.S. Pat. No. 6,201,532 which discloses an electronic gaming device with a deck mounted touch screen, all incorporated herein by reference.

THE INVENTION

This invention relates to a multiple handed video poker game wherein a single player is dealt a primary hand of 5 cards face up from a standard 52 card deck after a pre-determined bet is placed, with a pre-determined bet also placed on one or more secondary hands. The cards of the primary hand are arranged in one row, with each secondary hand to be arranged in another row below the primary hand. The player chooses which cards are held in the primary hand and which cards are discarded and moved to one or more secondary hands. Cards are then dealt to complete both the primary hand and each secondary hand.

A winning primary hand wins an amount based on a pre-determined pay scale and is multiplied by one or a win in the secondary hand. Any win in the secondary hand is based on a pre-determined pay scale and displayed on a credit meter.

If the primary hand does not yield a win, then the player loses the wagers on the primary and secondary hands.

Any or all of this game may be played with an actual dealer or with a computerized gaming console with a video screen such as a CRT or a flat screen display such as plasma, LCD, OLED, or LED. The game may be played on site at a legal game casino, in a non-gambling mode on-line over the internet, or off-line on a home computer using a disc such as a compact disc. The game could also be played as a game in gambling or non-gambling mode at a tavern, bar, home, or the like.

The present game can be played with multiple hands and/or with multiple players. The game can also be played on a video game system such as Microsoft Xbox Live, Sony Playstation, or Nintendo Wii.

The gaming console may include a computer with a random number generator, and an integrated touch system to facilitate player input. The touch system may be an infrared (IR) touch system, capacitive touch system, resistive touch system, surface acoustical wave touch system, or an inductive touch system, mounted to the cabinet or to the bezel of the screen. A keyboard, cursor, or other input device may be used.

DETAILED DESCRIPTION OF THE DRAWINGS

Figure 1:
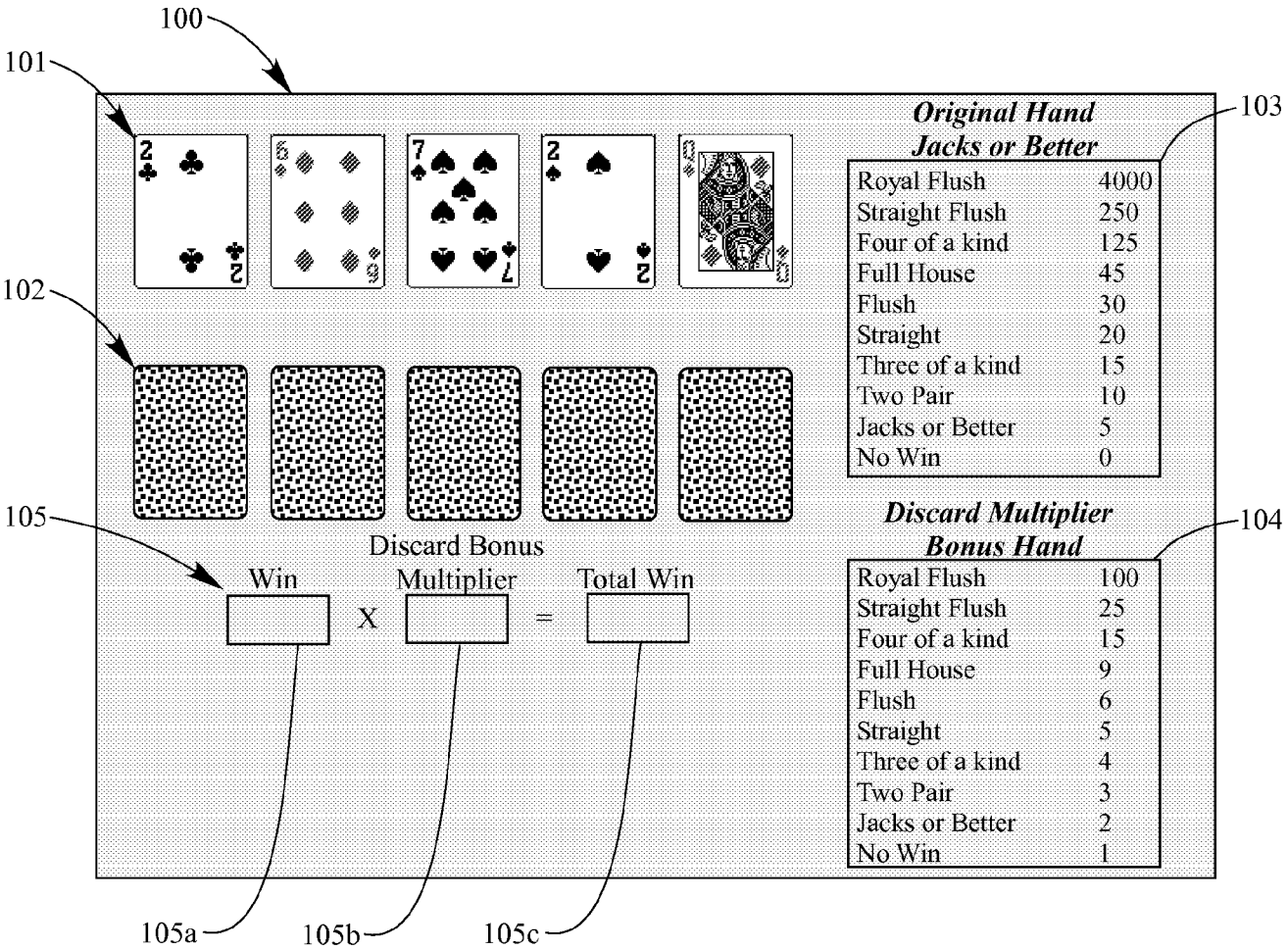
FIG. 1 shows an opening deal on the active game area with a primary hand dealt and place holders for a secondary hand.

FIG. 1 shows an opening deal on the active game area 100 with a primary hand 101 dealt and secondary hand 102. FIG. 1 shows the active game area 100, primary hand 101, place holders for secondary hand 102, primary pre-determined pay scale 103, secondary pre-determined pay scale 104, credit meter 105, primary win box 105*a*, secondary win box 105*b*, and total winnings box 105*c*.

Figure 1A:
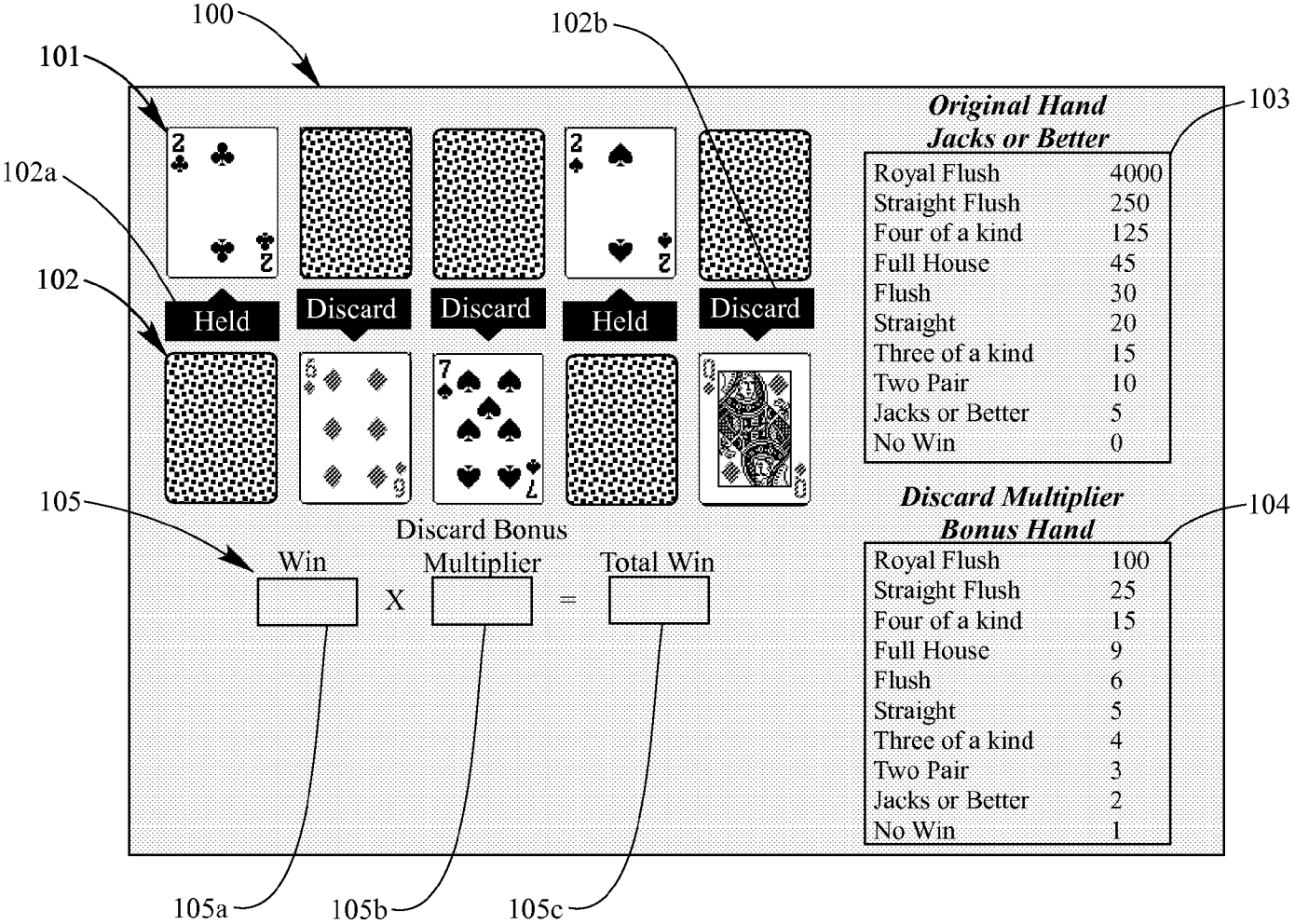
FIG. 1A shows holding and discarding cards from the primary hand to the secondary hand.

Once a player places a bet, a hand of 5 cards is dealt. FIG. 1A shows the active game area 100, primary hand 101, with two held cards (a pair of deuces), secondary hand 102 with three discards and two place holders for cards to be dealt, primary pre-determined pay scale 103, secondary pre-determined pay scale 104, credit meter 105, primary win box 105*a*, secondary win box 105*b*, and total winnings box 105*c*.

The player chooses which cards 102*a* will be held in the primary hand and which cards 102*b* will be discarded to the secondary hand. In FIG. 1A the two of clubs and the two of spades are held and the six of diamonds, the seven of spades and the queen of diamonds are discarded and move to the secondary hand 102.

Figure 1B:
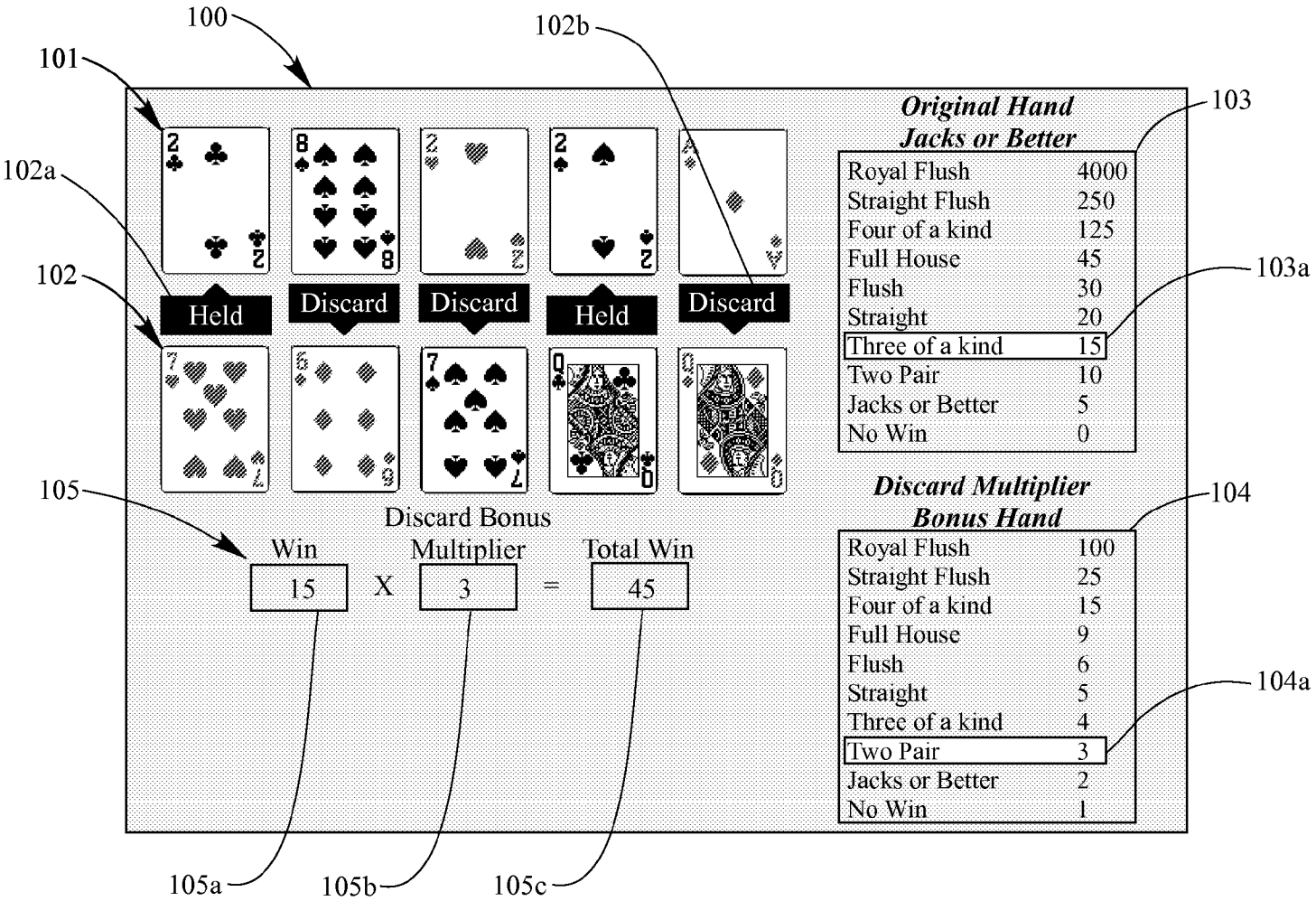
FIG. 1B shows the final winning hands.

FIG. 1B shows the active game area 100, primary hand 101, secondary hand 102, primary pre-determined pay scale 103, secondary pre-determined pay scale 104, credit meter 105, primary win box 105*a*, secondary win box 105*b*, and total winnings box 105*c*.

The primary hand 101 is dealt cards to replace the cards that were discarded. Cards are also dealt to the secondary hand 102 to complete the hand. The primary winnings 103*a* are displayed in the primary pre-determined pay scale 103. In this example, the player has three of a kind (three deuces), earning the player 15 credits. The winnings 104*a* in the secondary hand are displayed in the secondary hand pre-determined pay scale 104. In this example, the player has two pairs (queens and sevens), earning the player a multiplier of three. As seen in FIG. 1B, the total winnings 105*c* are calculated by the number of credits from the win box 105*a* multiplied by the multiplier in box 105*b*. In this example, the value in 105*a* is 15, the value in 105*b* is three, giving the player a total of 15×3 or 45 credits in box 105*c*.

Figure 2:
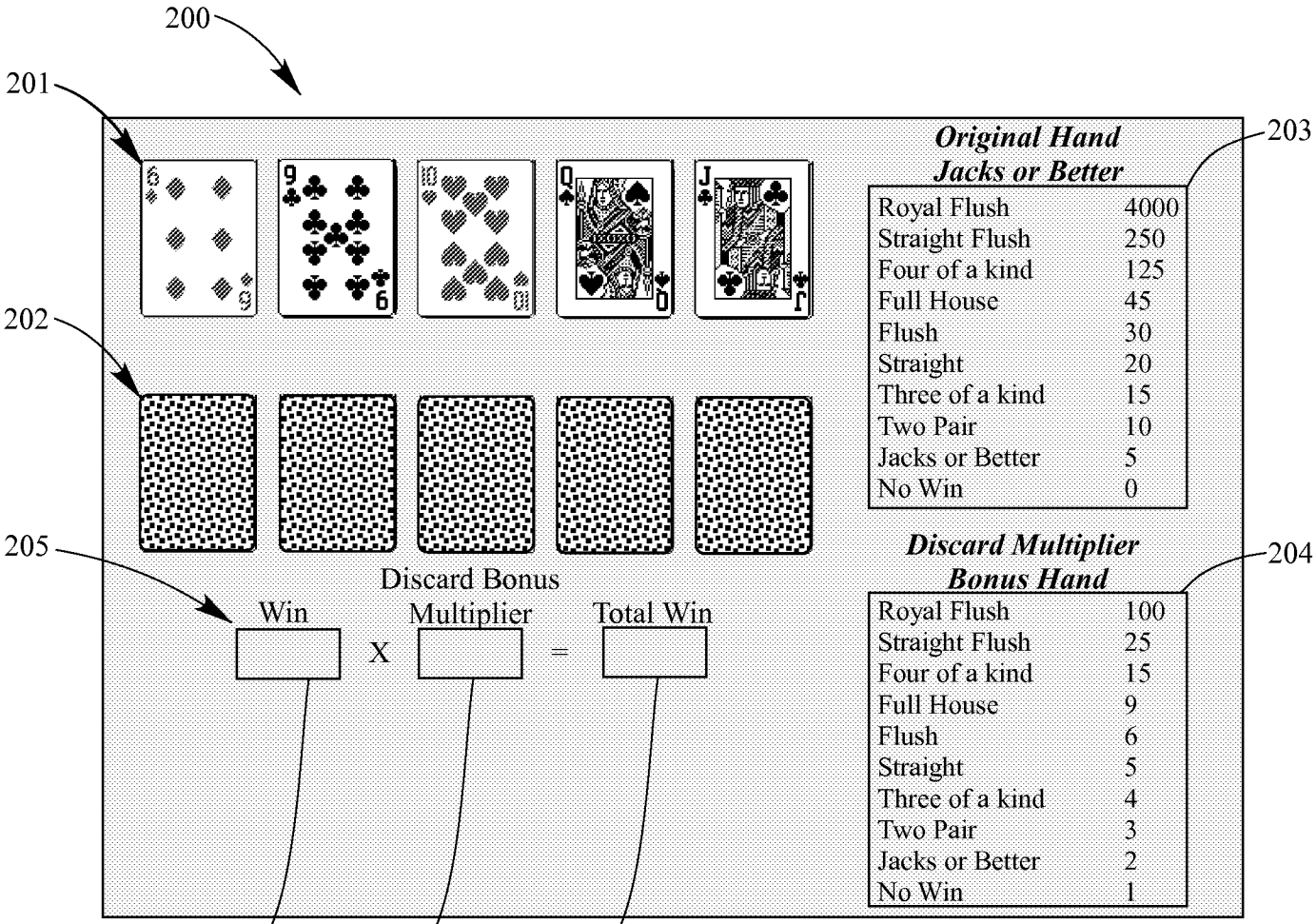
FIG. 2 shows an opening deal on the active game area with a primary hand dealt and place holders for a secondary hand.

FIG. 2 shows an opening deal on the active game area 200 with a primary hand 201 dealt and place holders for the secondary hand 202. FIG. 2 shows the active game area 200, primary hand 201, secondary hand 202, primary pre-determined pay scale 203, secondary pre-determined pay scale 204, credit meter 205, primary win box 205*a*, secondary win box 205*b*, and total winnings box 205*c*.

Figure 2A:
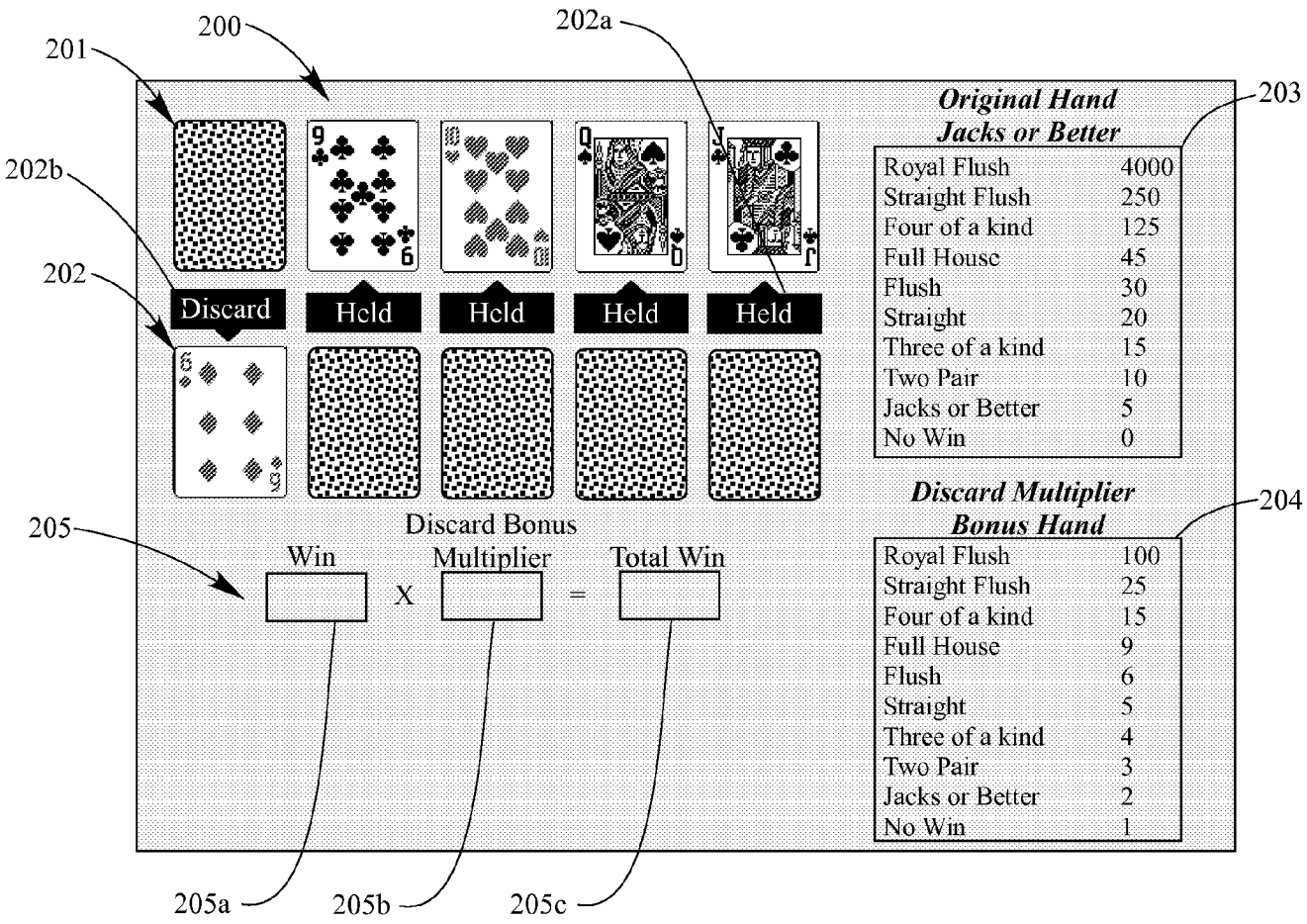
FIG. 2A shows holding and discarding cards from the primary hand to the secondary hand.

Once a player places a bet, a hand of 5 cards is dealt. FIG. 2A shows the active game area 200, primary hand 201, secondary hand 202, primary pre-determined pay scale 203, secondary pre-determined pay scale 204, credit meter 205, primary win box 205*a*, secondary win box 205*b*, and total winnings box 205*c*.

The player chooses which cards 202*a* will be held and which will be discarded 202*b*. In FIG. 2A the six of diamonds is discarded and moves to the secondary hand 202. The nine of clubs, the ten of hearts, the queen of spades and the jack of clubs are held.

Figure 2B:
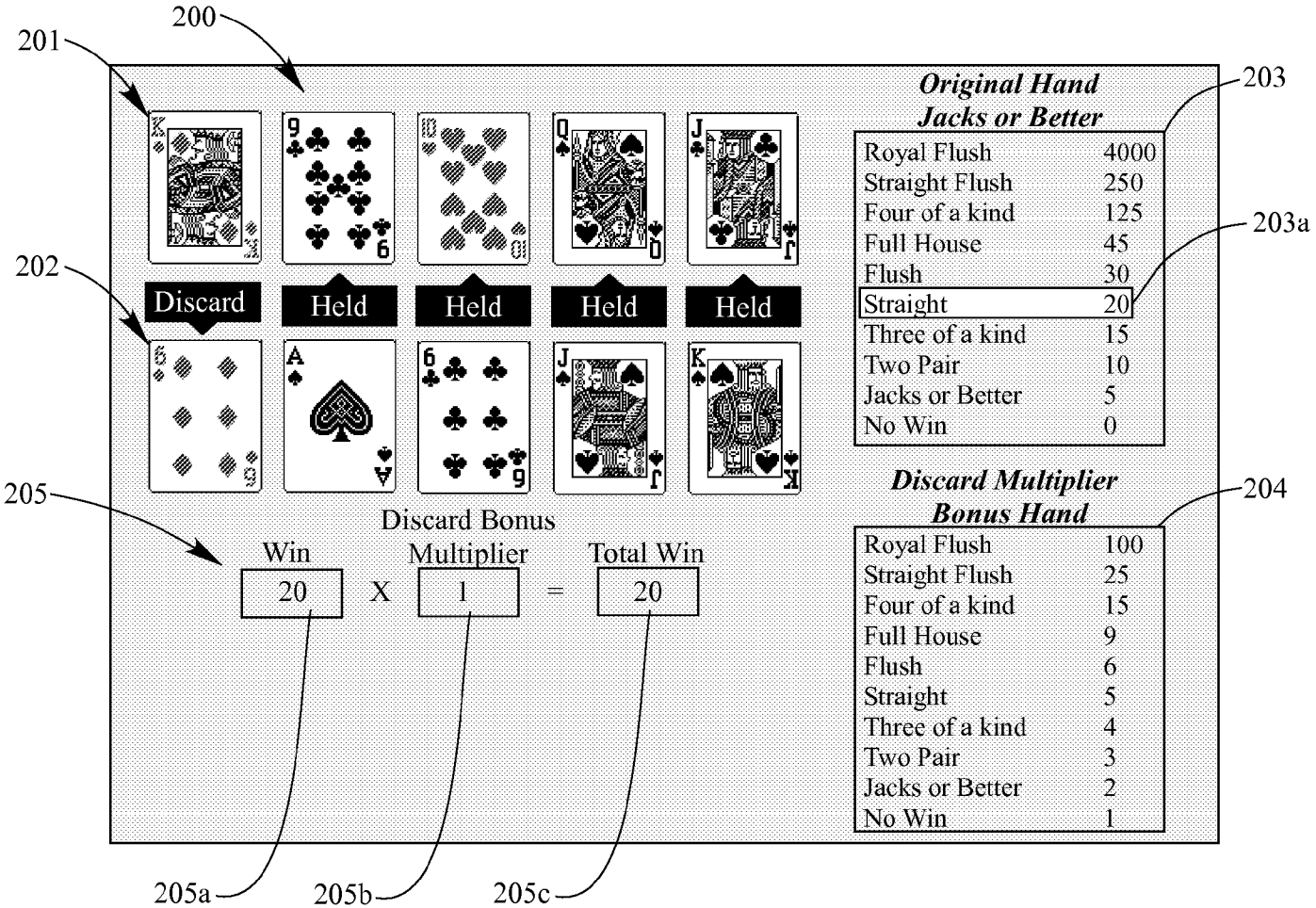
FIG. 2B shows the final winning hands.

FIG. 2B shows the active game area 200, primary hand 201, secondary hand 202, primary pre-determined pay scale 203, secondary pre-determined pay scale 204, credit meter 205, primary win box 205*a*, secondary win box 205*b*, and total winnings box 205*c*.

The primary hand 201 is dealt cards to replace the cards that were discarded. Cards are also dealt to the secondary hand 202 to complete the hand. The primary winnings 203*a* are displayed in the primary pre-determined pay scale 203. In this example, the player has a straight, earning the player 20 credits. In this example, the player does not have a winning secondary hand so a multiplier of one is used. As seen in FIG. 2B, the total winnings 205*c* are calculated by the number of credits from the win box 205*a* multiplied by the multiplier in box 205*b*. In this example, the value in 205*a* is 20 multiplied by a value of one in 205*b*, giving the player a total of 20 credits in box 205*c*.

Figure 3:
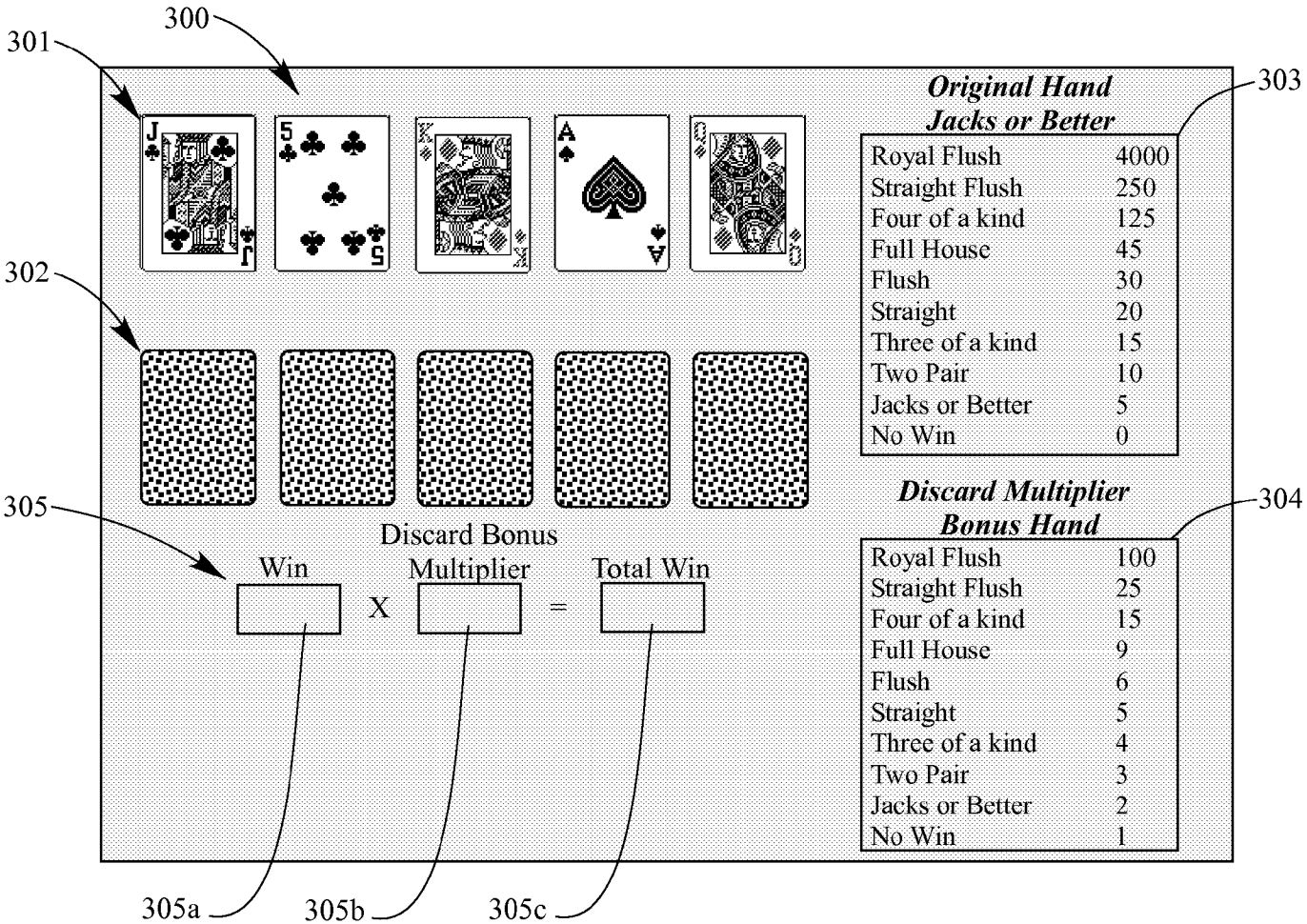
FIG. 3 shows an opening deal on the active game area with a primary hand dealt and place holders for a secondary hand.

FIG. 3 shows an opening deal on the active game area 300 with a primary hand 301 dealt and place holders for the secondary hand 302. FIG. 3 shows the active game area 300, primary hand 301, secondary hand 302, primary pre-determined pay scale 303, secondary pre-determined pay scale 304, credit meter 305, primary win box 305*a*, secondary win box 305*b*, and total winnings box 305*c*.

Figure 3A:
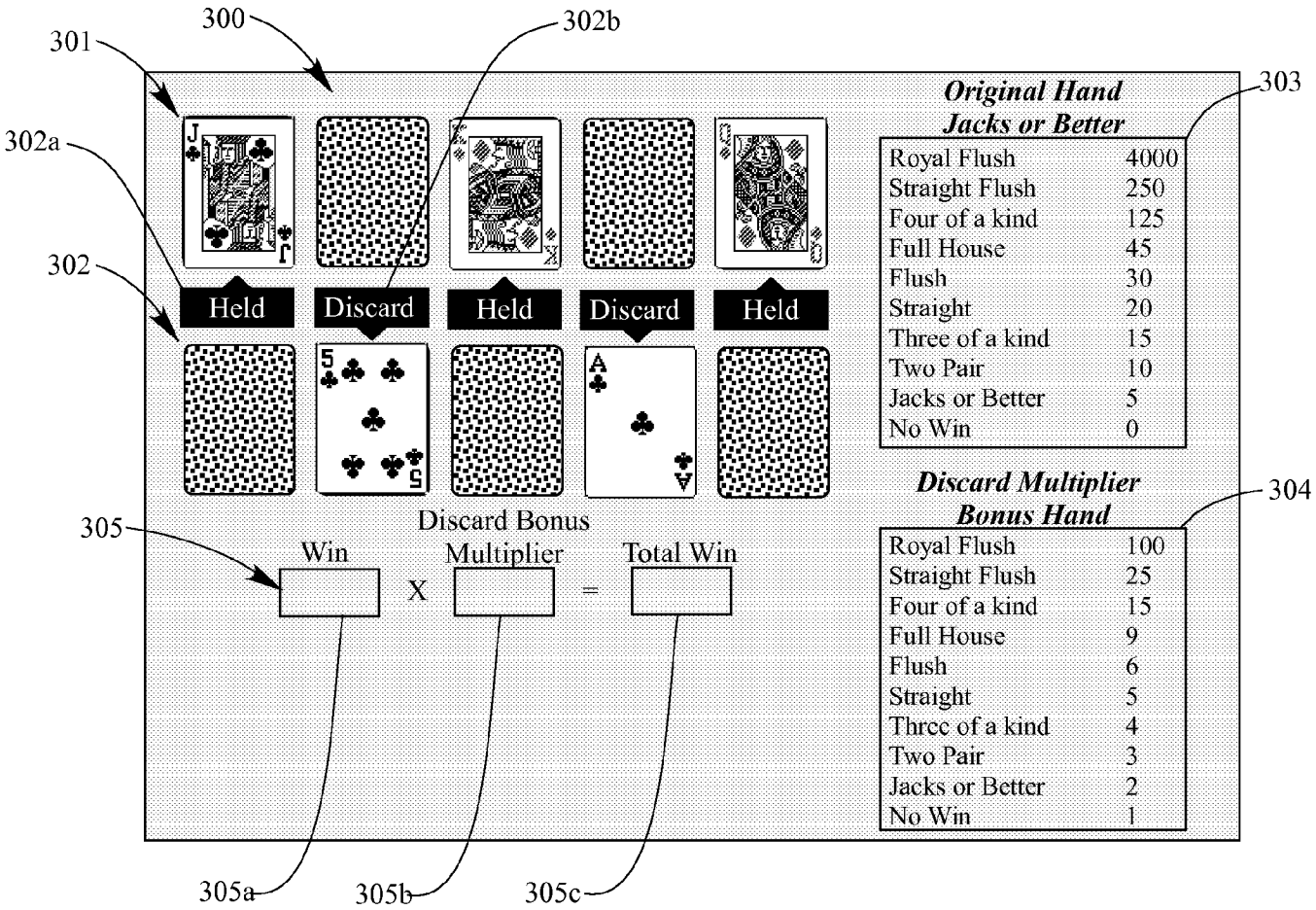
FIG. 3A shows holding and discarding cards from the primary hand to the secondary hand.

Once a player places a bet, a hand of 5 cards is dealt to the primary hand. FIG. 3A shows the active game area 300, primary hand 301, secondary hand 302, primary pre-determined pay scale 303, secondary pre-determined pay scale 304, credit meter 305, primary win box 305*a*, secondary win box 305*b*, and total winnings box 305*c*.

The player chooses which cards 302*a* will be held and which will be discarded 302*b*. In FIG. 3A the five of clubs, and the ace of clubs are discarded and move to the secondary hand 302. The jack of clubs, the king of diamonds, and the queen of diamonds are held in the primary hand.

Figure 3B:
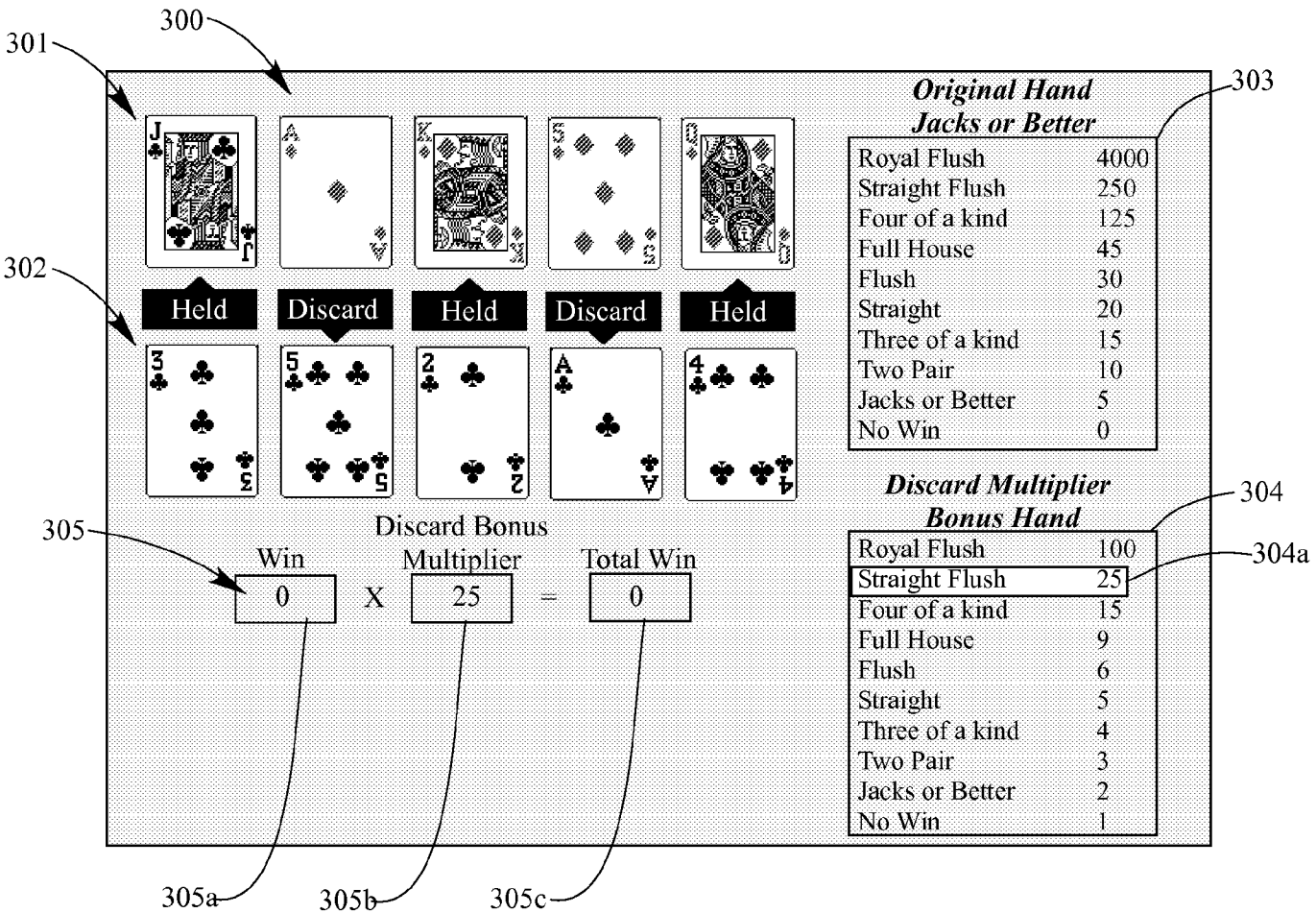
FIG. 3B shows the final winning hands.

FIG. 3B shows the active game area 300, primary hand 301, secondary hand 302, primary pre-determined pay scale 303, secondary pre-determined pay scale 304, credit meter 305, primary win box 305*a*, secondary win box 305*b*, and total winnings box 305*c*.

The primary hand 301 is dealt cards to replace the cards that were discarded. Cards are also dealt to the secondary hand 302 to complete the hand. In this example, the player does not have a winning hand, so zero credits are issued. The winnings in the secondary hand 304*a* are displayed in the secondary hand pre-determined pay scale 304. In this example, the player has a straight flush and wins 25 credits as the multiplier. As seen in FIG. 3B, the total winnings 305*c* are calculated by the number of credits from the win box 305*a* multiplied by the multiplier in box 305*b*. In this example, the value in 305*a* is zero, and the value in 305*b* is 25, giving the player a total of zero credits (0×25=0) in box 305*c*.

Figure 4:
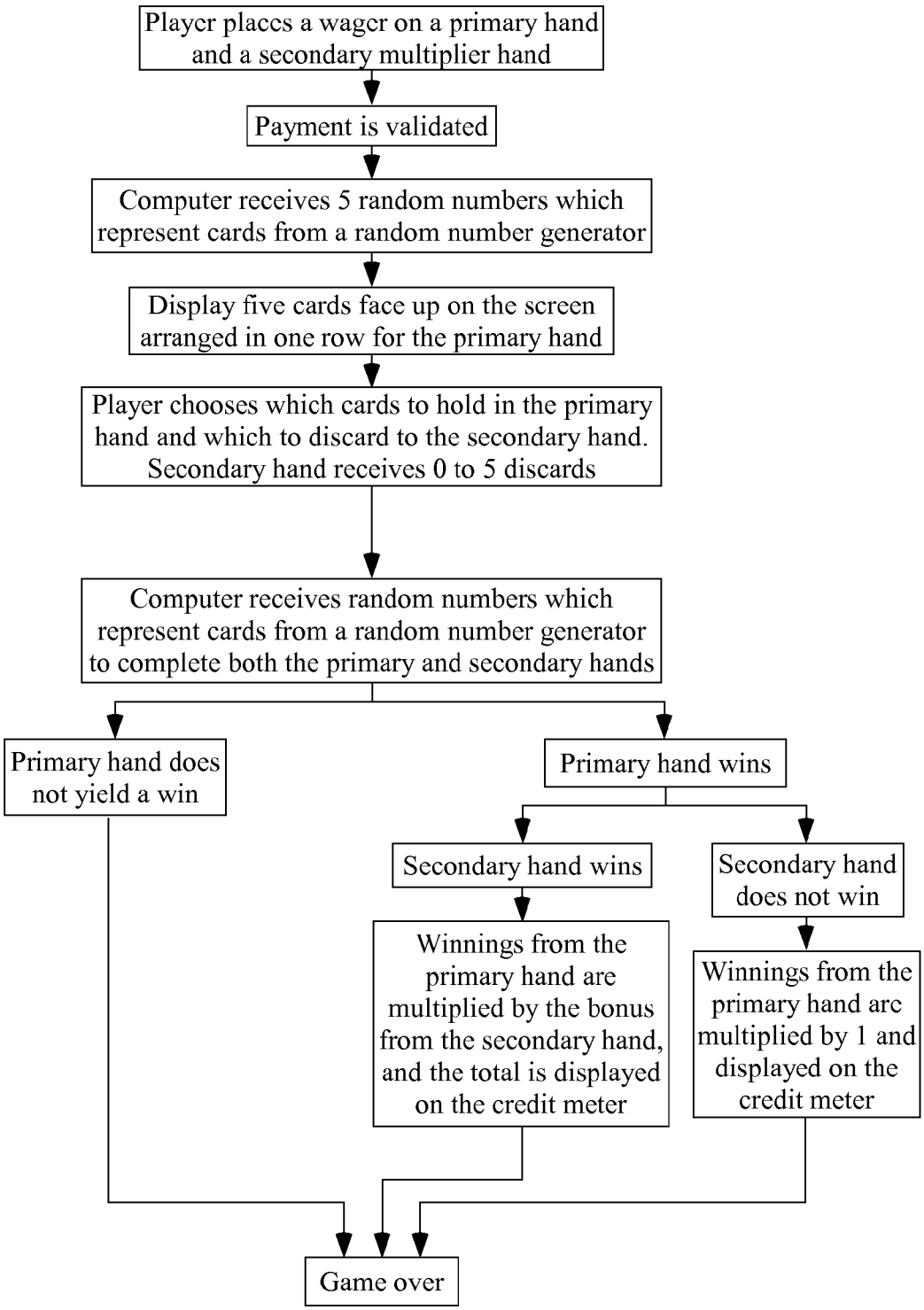
FIG. 4 shows a block diagram of one embodiment of game play.

FIG. 4 shows a flowchart of game play. The player places a wager on the primary hand and the secondary hand. The computer validates the payment and sends a signal to the random number generator to send out five random numbers that represent cards. The computer receives the random numbers and displays the representative cards face up on the screen and arranges them in one row of five for the primary hand. There are five secondary blank cards (place holders) arranged in one row and located under the primary row of five dealt cards. The player then chooses which cards to hold in the primary hand and which to discard to the secondary hand. The computer sends a signal to the random number generator to send out up to five random numbers that represent cards. In some embodiments, there are additional secondary hands. In such embodiments, the computer will send out signals for additional random numbers and cards for the additional secondary hands. The computer receives the random numbers and completes both the primary and secondary hand. If the primary hand does not yield a win, the player will not win any credits and the game is over. If the primary hand wins and secondary hand does not win, the winnings from the primary hand are multiplied by one, completing the game. If the primary and secondary hands yield a win then the winnings from the primary hand are multiplied by a bonus from the secondary hand and the total winnings are displayed on the credit meter, completing the game.

Figure 5:
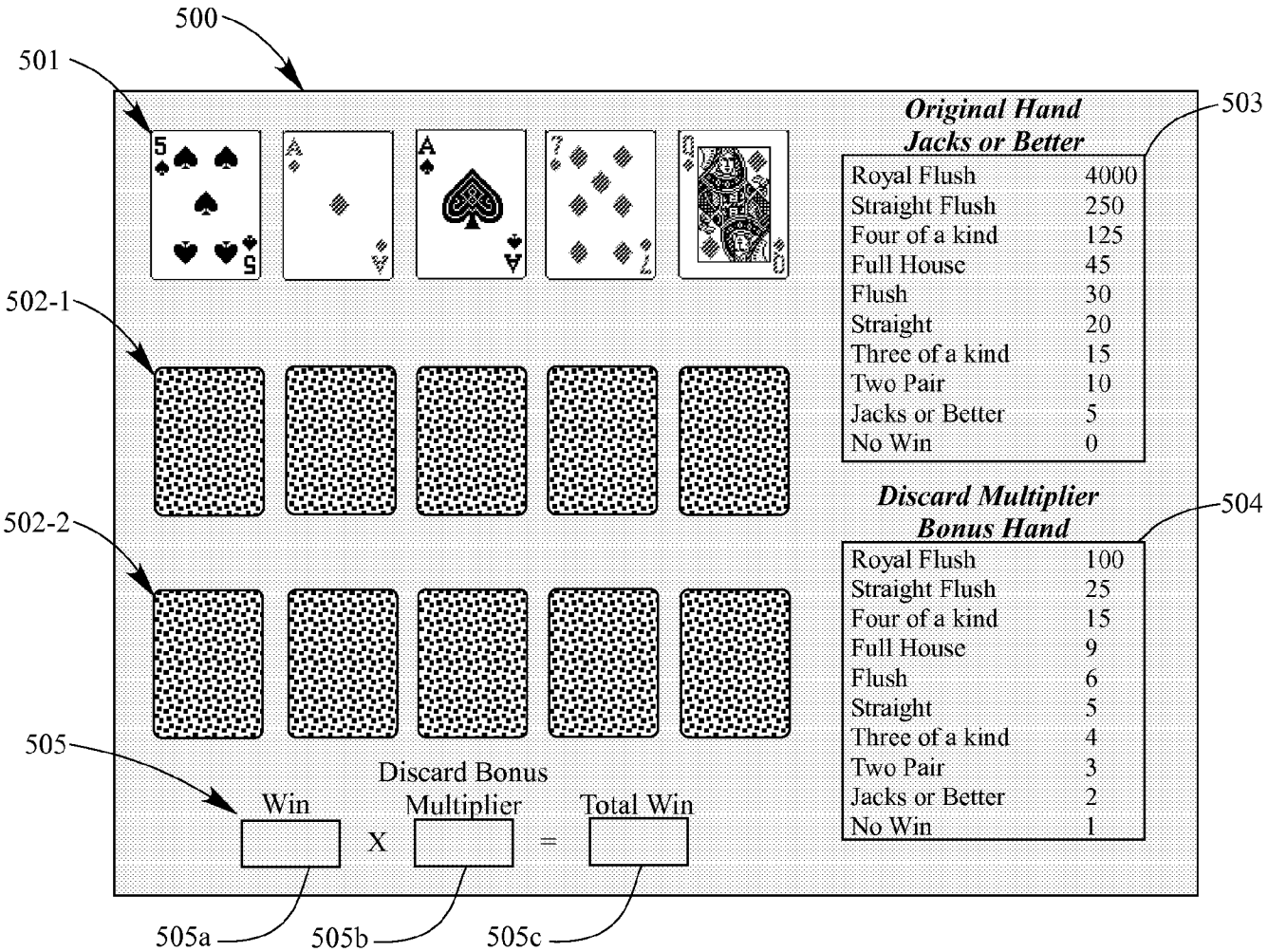
FIG. 5 shows an opening deal on the active game area with a primary hand dealt and place holders for two secondary hands.

FIG. 5 shows an opening deal on the active game area 500 with a primary hand 501 dealt and secondary hands 502-1 and 502-2. FIG. 5 shows the active game area 500, primary hand 501, place holders for secondary hands 502-1 and 502-2, primary pre-determined pay scale 503, secondary pre-determined pay scale 504, credit meter 505, primary win box 505*a*, secondary win box 505*b*, and total winnings box 505*c*.

Figure 5A:
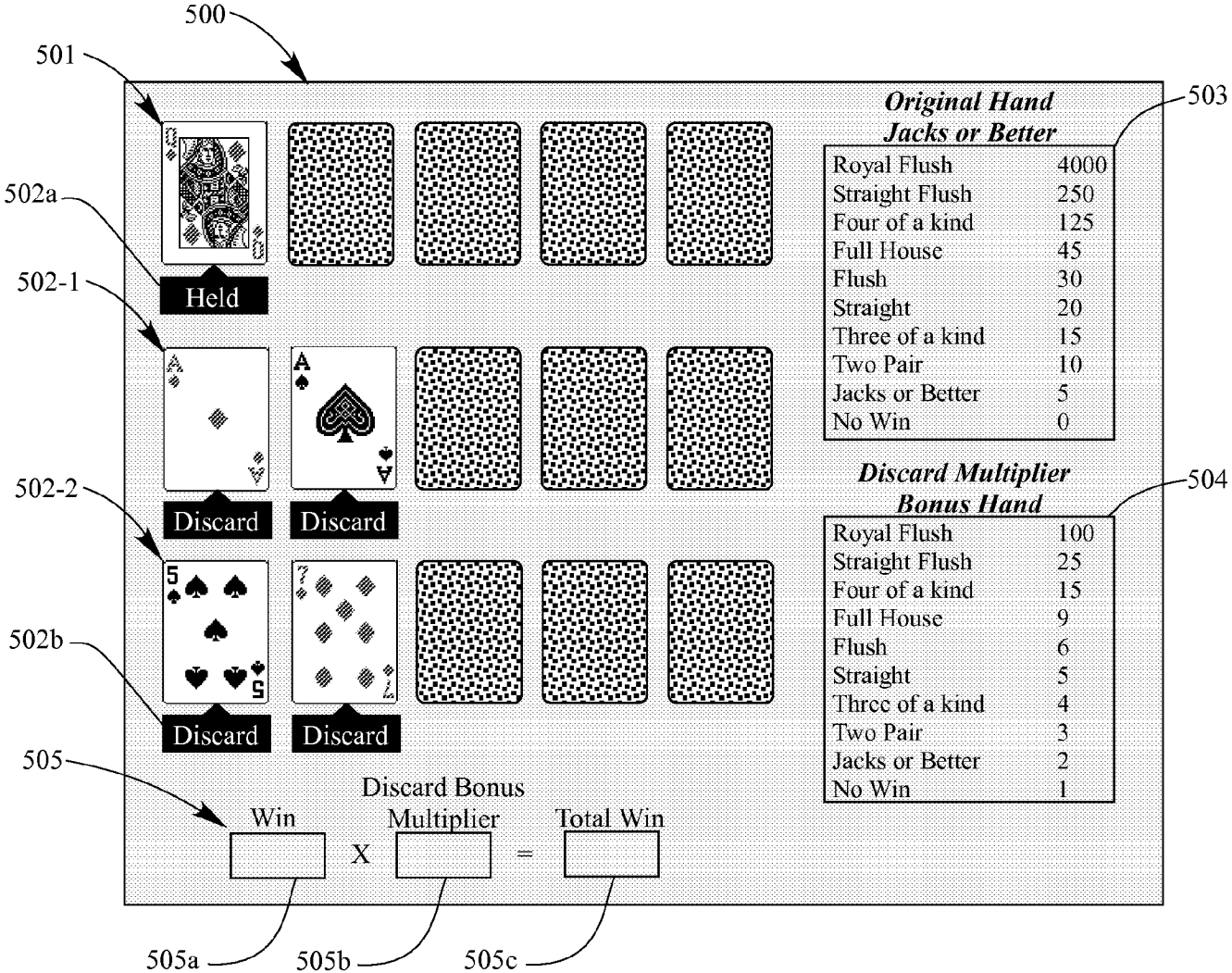
FIG. 5A shows holding and discarding cards from the primary hand to the two secondary hands.

Once a player places a bet, a hand of 5 cards is dealt. FIG. 5A shows the active game area 500, primary hand 501, with one held card (queen of diamonds), secondary hand 502-1 with two discards from the primary hand 501 and three place holders for cards to be dealt, secondary hand 502-2 with two discards from the primary hand 501 and three place holders for cards to be dealt, primary pre-determined pay scale 503, secondary pre-determined pay scale 504, credit meter 505, primary win box 505*a*, secondary win box 505*b*, and total winnings box 505*c*.

The player chooses which cards 502*a* will be held in the primary hand 501 and which cards 502*b* will be discarded to the secondary hands 502-1 and 502-2. Although two secondary hands are illustrated in FIG. 5A, any number n secondary hands can be used. In such embodiment, zero to five cards are discarded into n secondary hands where n is an integer of one or more. If a secondary hand does not win, it's multiple is one. If there are n secondary hands and none wins, the multiple for each secondary hand is one, and the total multiplier is n. For example, if there are two secondary hands and both lose, the total multiplier is one plus one summing to two. If there are three secondary hands and all lose, the total multiplier is one plus one plus one summing to three.

In one embodiment, the player is given the option of creating additional secondary hands by placing a wager or bet on each elected secondary hand up to n hands. In order to accommodate n hands it may be necessary to use multiple decks of cards. The player must have a winning primary hand in order to take advantage of the multiplier from one or more secondary hands. The player must place a bet on the primary hand and at least one secondary hand.

In FIG. 5A the queen of diamonds is held and the other four cards (ace of diamonds, ace of spades, five of spades, and seven of diamonds) are discarded and moved to the secondary hands as shown.

Figure 5B:
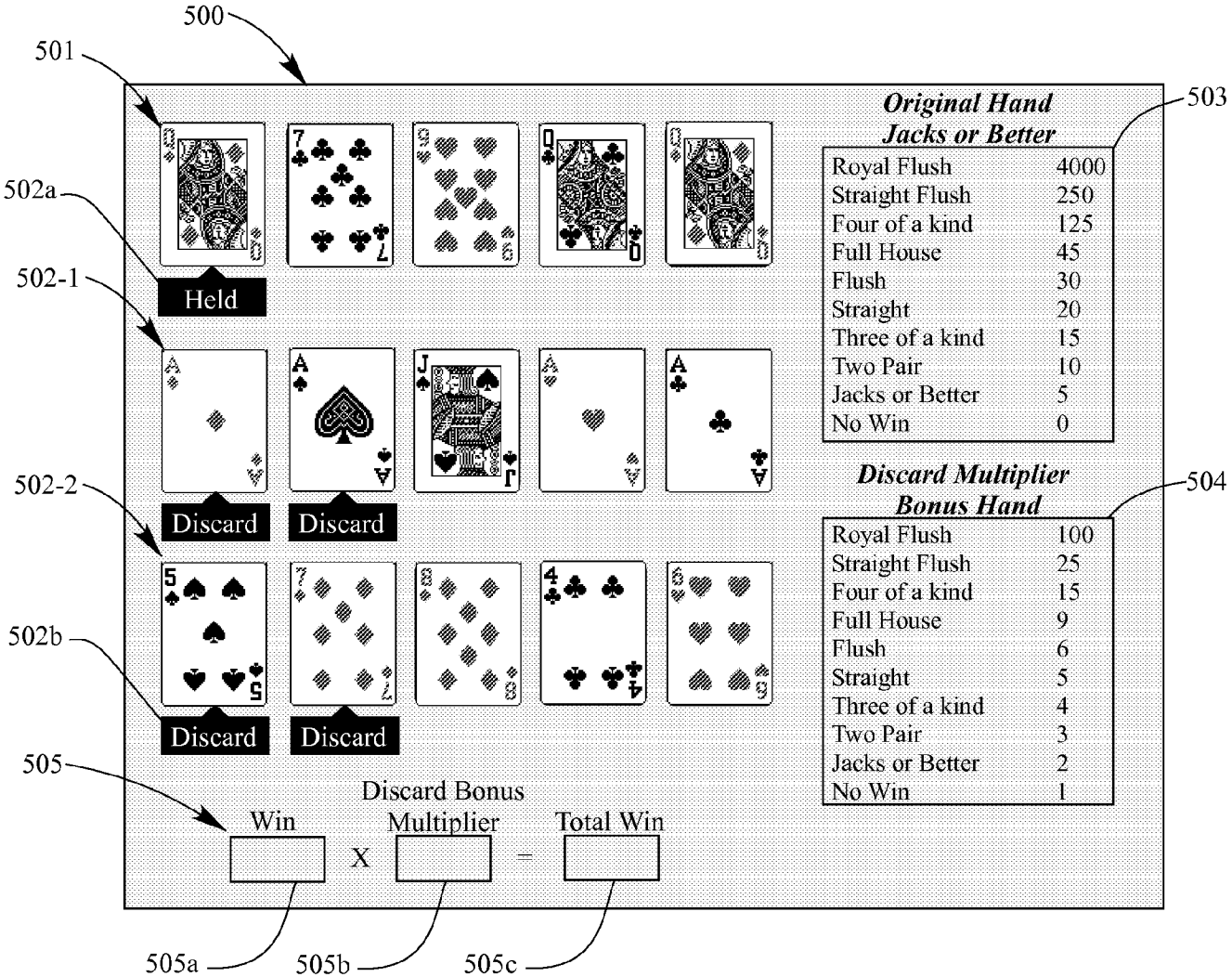
FIG. 5B shows the completed draw for the primary hand and the two secondary hands.

FIG. 5B shows the active game area 500, primary hand 501, secondary hands 502-1, 502-2, primary pre-determined pay scale 503, secondary pre-determined pay scale 504, credit meter 505, primary win box 505*a*, secondary win box 505*b*, and total winnings box 505*c*. The primary hand 501 is dealt cards to replace the cards that were discarded. Cards are also dealt to the secondary hands 502-1, 502-2 to complete the hands.

Figure 5C:
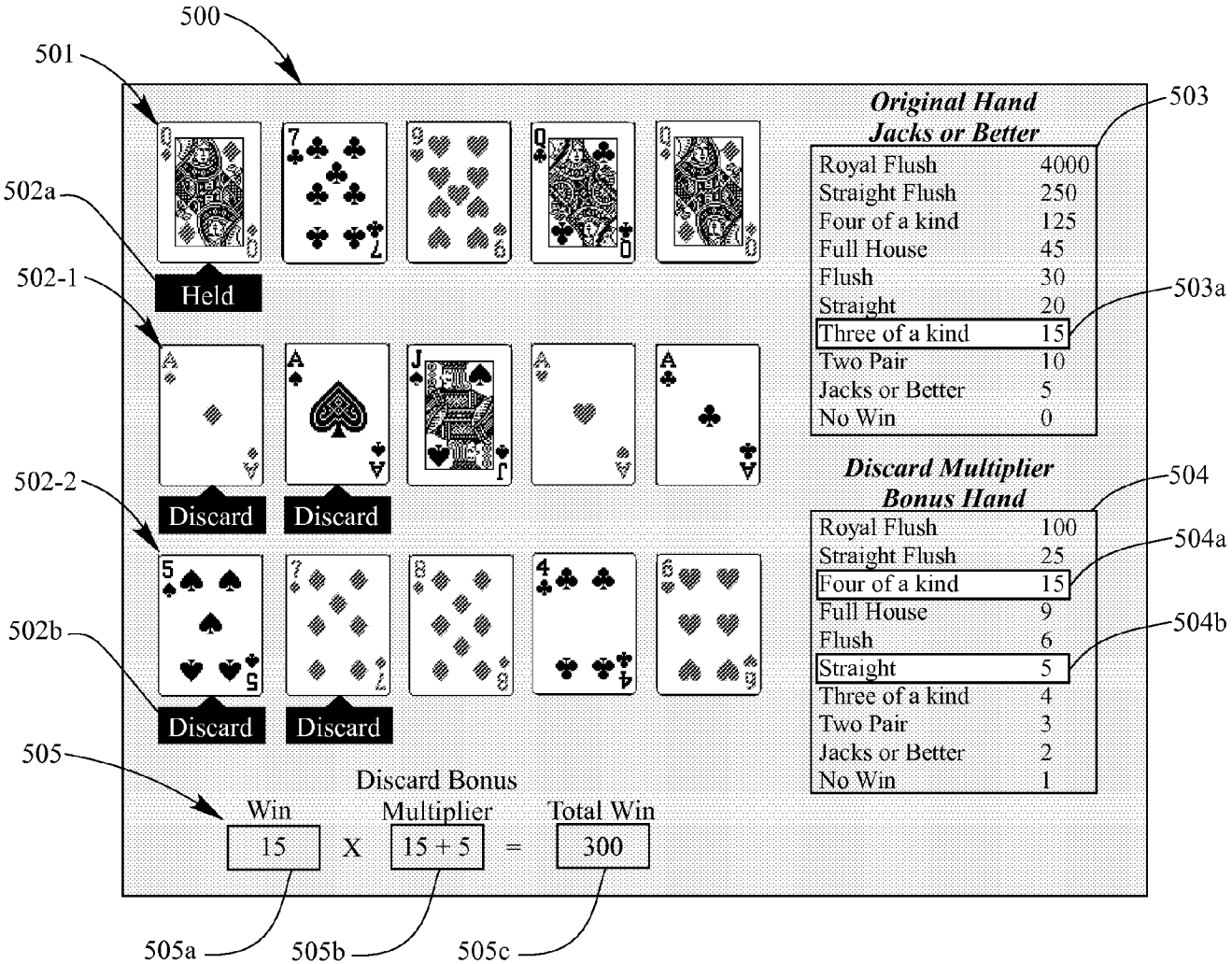
FIG. 5C shows the final winning hands.

FIG. 5C shows the final winning hands. The primary winning 503*a* are displayed in the primary pre-determined pay scale 503. In this example, the player has three of a kind (three queens), earning the player 15 credits. The winnings 504*a* in the secondary hand 502-1 are displayed in the secondary hand pre-determined pay scale 504. In this example, the player has four aces in 502-1, earning the player a multiplier of 15. The winnings 504*b* in the secondary hand 502-2 are displayed in the secondary hand pre-determined pay scale 504. In this example, the player has a straight in 502-2 earning the player a multiplier of five. The two multipliers are added together for a value of 20.

As seen in FIG. 5C the total winnings 505*c* are calculated by the number of credits from the win box 505*a* multiplied by the multiplier in box 505*b*. In this example, the value in 505*a* is 15, the value in 505*b* is 20, giving the player a total of 15×20 or 300 credits in box 505*c*.

Figure 6:
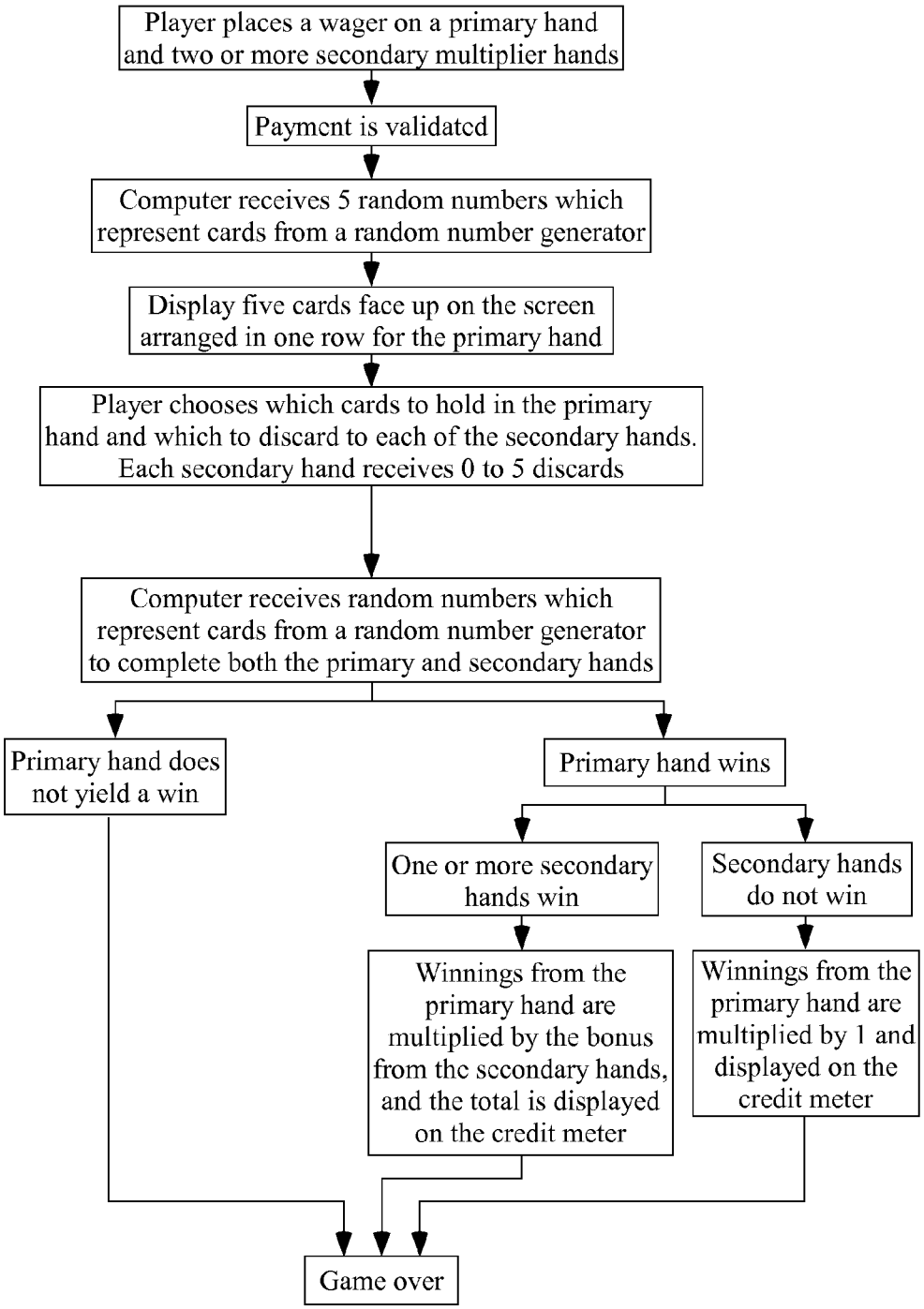
FIG. 6 is a block diagram of another embodiment of game play.

FIG. 6 is a block diagram of another embodiment of game play. The player places a wager on the primary hand and two or more secondary hands. The computer validates the payment and sends a signal to the random number generator to send out five random numbers that represent cards for the primary hand. The computer receives the random numbers and displays the representative cards face up on the screen and arranges them in one row of five for the primary hand. There are ten secondary blank cards (place holders) arranged in two rows of five, each row of five located under the primary row of five dealt cards. The player then chooses which cards to hold in the primary hand and which to discard to each secondary hand. The computer sends a signal to the random number generator to send out up to ten random numbers that represent cards. If additional secondary hands are used, additional random numbers and cards will be needed up to five per additional secondary hand. The computer receives the random numbers and completes both the primary and secondary hands. If the primary hand does not yield a win, the player will not win any credits and the game is over. If the primary hand wins and no secondary hand wins, the winnings from the primary hand are multiplied by the (sum of one plus one) two, completing the game. If the primary and one or both secondary hands yield a win, the winnings from the primary hand are multiplied by a bonus from the total of each secondary hand and the winnings are displayed on the credit meter completing the game.

Figure 7:
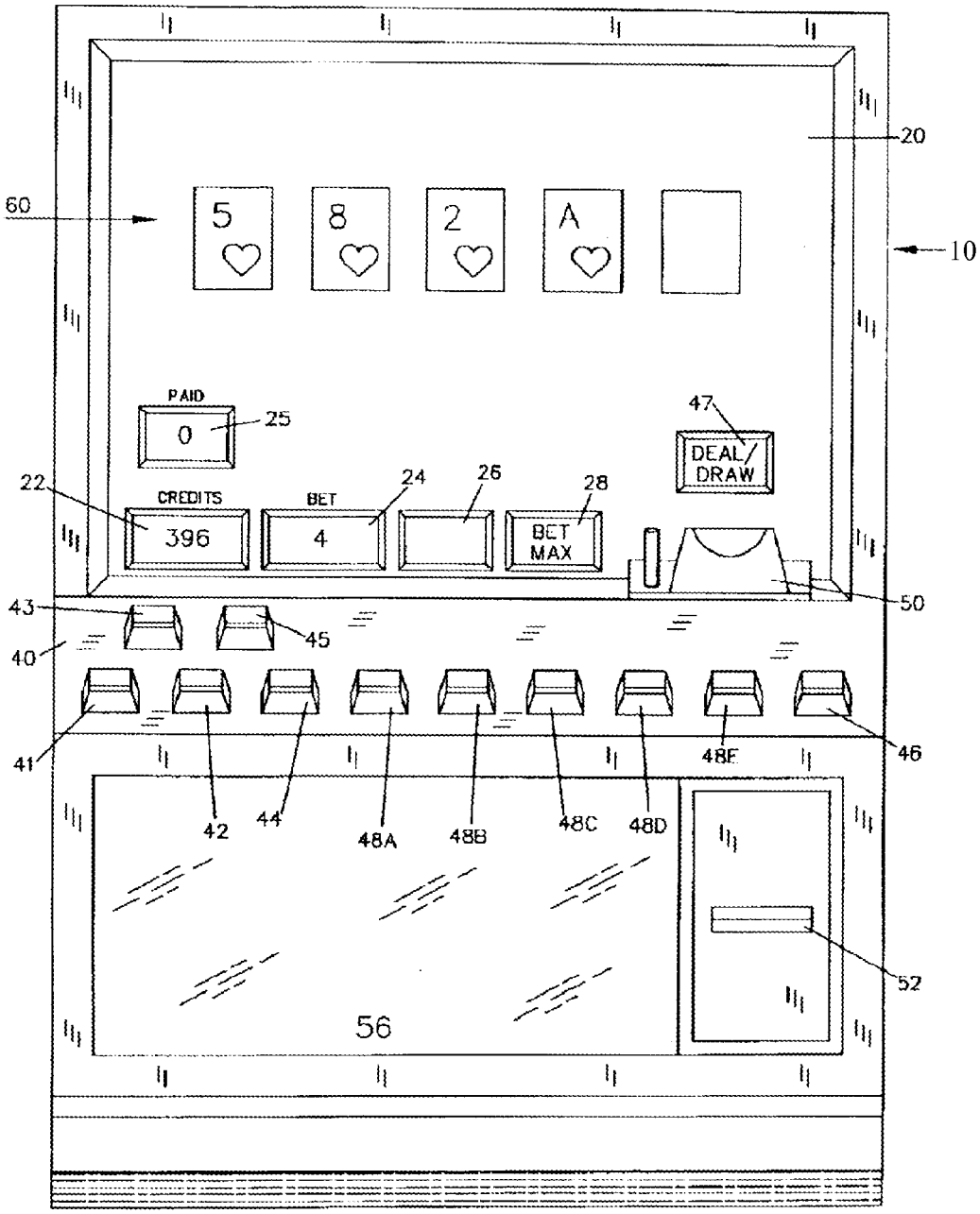
FIG. 7 illustrates a typical gaming console.

FIG. 7 shows a typical electronic video gaming machine 10 that is configured to provide to a player apparatus for the method and system of the present invention. The electronic video gaming machine 10 includes a conventional coin acceptor 50 into which the player can insert coins or gaming tokens and a bill acceptor 52 mounted to the gaming machine 10 and into which the player can insert paper currency. The use of coins, tokens or paper currency is one mechanism by which a player may wager on the poker hands the player wishes to play. Also in the electronic video gaming machine 10, a credit meter display 22 is provided to show the amount of credits that the player has accrued on the gaming machine 10, either by inserting coins, tokens or paper currency or from winning plays achieved by the player. Whenever the player makes a wager, the amount of the wager is subtracted from the credit meter display 22. Whenever the player achieves a winning play during the play of the game, the amount of the winning play is added to the credit meter display 22.

A conventional payout hopper is also located on the interior of the gaming machine and is used to dispense coins or tokens to the player into a payout tray 56 when the player wishes to collect any winning amounts the player has accrued. Other suitable and conventional payout mechanisms can be used, such as a ticket printer or other cashless payout devices.

The gaming machine 10 also includes a video screen display 20 of any suitable size or type upon which representations of playing cards are displayed. In one embodiment, one or more hands can be displayed on the video screen display 20 at the same time. As illustrated in FIG. 7, a first hand is shown at location 60. Each hand would preferably have five card locations preferably from left to right in a horizontal row, although other manners of displaying multiple hands including stacks of cards can be used. The video screen display 20 also contains a location at which the amount wagered on each hand is shown, for example, "Bet" 24. In this illustration, the player has bet 4 credits.

A button panel 40 is also provided on the gaming machine 10 with buttons mounted on the button panel 40 to be used by the player to control the operation of the gaming machine 10. Any suitable number or configuration of the buttons on the button panel can be used and, alternatively, conventional touch screen technology can be used for any or all of the buttons mounted on the button panel.

A typical button arrangement is shown on the button panel 40 in FIG. 7. A "BET ONE" button 42 is provided to allow the player to wager one credit at a time. A "BET MAX" button 44 is provided to allow the player to wager the maximum amount of credits permitted by the configuration of the gaming machine 10. Any number of credits can be set as the minimum or maximum amount that it is possible to wager on each hand. Typically, five credits may be the maximum number of credits for any particular hand. Alternatively, a BET ONE location 26 and a BET MAX location 28 can be provided on the video screen 20 to allow the player to wager by using conventional touch screen technology.

A conventional "DEAL/DRAW" button 46 is also provided on the button panel 40 which is used by the player to activate the initial deal of the cards at the deal stage of the method of play or the dealing of replacement cards at the draw stage of the method of play as is appropriate. Similarly, a DEAL/DRAW location 47 can be provided on the video screen 20 to allow the player to select either the deal step or the draw step by using conventional touch screen technology. The button panel 40 is also provided with five "CARD" buttons 48A, 48B, 48C, 48D and 48E associated with each horizontal card location on the video screen display: card button 48A is associated with the left most card location, card button 48B is associated with the second from the left card location, card button 48C is associated with the middle card location, card button 48D is associated with the second from the right card location and card button 48E is associated with the right most card location. Each card button is preferably aligned below the card locations so that the player can easily associate the appropriate card button with the appropriate card location. The method of play of the various versions of the present invention will now be described. After the player has inserted an appropriate amount of coins, tokens or paper currency to add a sufficient amount of credits on the credit display meter 22, the player makes his initial wager. The player may press the BET ONE button 42 one or more times to bet in single increments or the player may merely press the "BET MAX" button 44 and the maximum number of credits are applied, for example, five credits would be wagered. The player can also use the touch screen locations to make his wager as described above.

To play the poker game, the player establishes a pool of credits, sets the wager, deals the cards, chooses which cards to hold and discard, draws replacement cards, and collects credits for winning card combinations, with enhancements for any bonus card 61 dealt and/or drawn.

Buttons

In one embodiment, a set of buttons are mounted on the button panel 40 and are used by the player to control the functions of the poker game: Bet One 42, Bet Max 44, Deal/Draw 46, Help 43, Pay Table 45, and Cash Out 41. Any or all of these control buttons may be displayed on the video display 20 and/or buttons electronically connected to the gaming device. If necessary, any number of buttons may be added to further facilitate control of the game, such as Hold buttons to "hold" the cards shown on the video display displayed.

Meters

In one embodiment, meters are shown on the video display screen to display the salient information for the game: Credits meter 22, Bet meter 24, and Paid meter 25. The Credits meter 22 displays the total number credits remaining in the credit pool; the Bet meter 24 displays the amount wagered on the current, previous, and/or upcoming poker hand and is associated with the Bet One 42 and Bet Max 44 buttons; and the Paid meter 25 displays the amount of credits won on the current or previous poker hand.

Credit Pool

In one embodiment, the player deposits coins, tokens, paper currency, credit cards, debit cards, or other forms of physical and/or electronic currency into the coin acceptor slot 50 or a paper currency bill acceptor 52 to establish a pool of credits. The amount of this common pool of credits is displayed to the player on the credit meter 22. The pool of credits increases and decreases according to the player's wins or losses and may be supplemented, if necessary, by the player by additional deposits of coins, tokens, paper currency, credit cards, debit cards, or other forms of physical and/or electronic currency.

Set the Wager

In one embodiment, the player sets the value of the wager by using the Bet One 42 and Bet Max 44 buttons. The bet may range between one credit and N-credits, with N equal to a predetermined maximum or set by the current value of the Credit Pool. The typical video poker gaming machine uses a five credit maximum wager.

Deck of Cards

In one embodiment, each card dealt is selected from one or more suitable decks of cards such as one or more fifty-two card traditional decks (i.e. the traditional four suits of Spades, Hearts, Diamonds, Clubs, with thirteen ranks in each suit of 2, 3, 4, 5, 6, 7, 8, 9, 10, Jack, Queen, King and Ace) plus any bonus cards added before or after the deal or the draw.

Deal of Cards

In one embodiment, the player causes the machine 10 to deal the cards by pressing the Deal button 46. Once the Deal button 46 is pressed, the wager is final and non-refundable. For each deal, the machine 10 randomly displays five cards face-up in the five card positions. In a single standard deck embodiment, a displayed card is removed from the deck and may not be dealt again during that game. Typically, only the remaining non-dealt cards in the deck are used to replace a dealt card.

Hold and Discard

In one embodiment, the player selects which cards to hold and which cards to discard using the buttons on the machine 10 or touching the cards on the video display 20 (i.e. pressing a button or touching a card will "hold" the card) Alternatively, the machine 10 may automatically select cards to hold and/or discard and then allow the player to override the selections by using the buttons or touching the display screen 20. This may be useful in a training mode.

Winning Card Combinations

In one embodiment, the player is paid for predetermined winning combinations of cards that appear in the final hand. Each winning combination pays the amount indicated on a pre-determined pay scale times the total amount wagered on that hand. Furthermore, the value of a winning card combination may be enhanced by the appearance of one or more Multi-Draw Bonus cards during the deal or draw. All enhanced values are also reflected on the pre-determined pay scale.

SUMMARY

The foregoing description of various embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. In a method of playing video poker using a computer, a random number generator, and a video display screen, the improvement which comprises:

dealing a first primary poker hand of 5 cards;

selecting 0 to 5 cards from the first primary poker hand to be discarded into a secondary poker hand;

discarding the selected cards into the secondary poker hand;

dealing 0 to 5 cards to the first primary poker hand to replace any discarded card and form a final primary poker hand of 5 cards;

dealing 0 to 5 cards to complete the final secondary poker hand of 5 cards;

determining a payout based on a pre-determined scale for the final primary poker hand when it is a winning poker hand;

determining a multiple greater than one based on a pre-determined pay scale for each final secondary poker hand, when the final secondary poker hand is a winning poker hand of Jacks or better;

and multiplying the payout of the final primary winning poker hand with the multiple greater than one determined by the pre-determined pay scale for the final secondary poker hand to determine the final winnings.

2. A video poker game system including a gaming console with a computer, a random number generator, and a video display using a deck of cards, said system comprising the steps of:

dealing a first primary poker hand of 5 cards;

selecting 0 to 5 cards from the first primary poker hand to be discarded into n secondary poker hands where n is an integer of one or more;

discarding the selected cards into n secondary poker hands;

dealing 0 to 5 cards to the first primary poker hand to replace any discarded card and form a final primary poker hand of 5 cards;

dealing 0 to 5 cards per secondary hand to complete each secondary poker hand with 5 cards;

determining a payout with a pre-determined pay scale for the final primary poker hand;

determining a multiple of one or more with a pre-determined pay scale for each final secondary poker hand, the multiple being greater than one for each secondary poker hand when the secondary poker hand is a winning hand of Jacks or better;

adding together the multiples for each secondary poker hand to obtain a final total multiplier of n or more;

and multiplying the payout of the final primary poker hand with the total multiplier of n or more to determine the final winnings.

3. In a video poker game system comprising a computer, a random number generator, and a video display and using a deck of cards, wherein a primary poker hand is established and a payout is determined based on a pre-determined pay scale for a winning primary poker hand, the improvement wherein one or more secondary poker hands is completed and a multiplier is determined based on a pre-determined pay scale for each completed secondary poker hand, the multiplier being greater than one for each secondary poker hand when the completed secondary poker hand is a winning poker hand of Jacks or better, the multipliers for the winning secondary hands being added together to form a total multiplier, and multiplying the payout of the winning primary poker hand with the total multiplier to determine the final winnings.

* * * * *